US010294738B2

(12) United States Patent
Koskinen et al.

(10) Patent No.: US 10,294,738 B2
(45) Date of Patent: May 21, 2019

(54) DRILL ROD CHANGER, ROCK DRILLING UNIT AND METHOD OF CHANGING DRILL RODS

(71) Applicant: SANDVIK MINING AND CONSTRUCTION OY, Tampere (FI)

(72) Inventors: Jouni Koskinen, Tampere (FI); Antti Pajunen, Tampere (FI); Ilmo Pyorny, Tampere (FI); Risto Haataja, Tampere (FI); Timo Seppala, Tampere (FI)

(73) Assignee: Sandvik Mining and Construction OY, Tampere (FI)

( * ) Notice: Subject to any disclaimer, the term of this patent is extended or adjusted under 35 U.S.C. 154(b) by 196 days.

(21) Appl. No.: 15/379,387

(22) Filed: Dec. 14, 2016

(65) Prior Publication Data

US 2017/0175462 A1 Jun. 22, 2017

(30) Foreign Application Priority Data

Dec. 18, 2015 (EP) ..... 15201043

(51) Int. Cl.

| | |
|---|---|
| ***E21B 19/14*** | (2006.01) |
| ***E21B 7/02*** | (2006.01) |
| ***E21B 19/16*** | (2006.01) |
| ***E21B 19/087*** | (2006.01) |
| ***E21B 19/20*** | (2006.01) |

(52) U.S. Cl.

CPC ..... *E21B 19/146* (2013.01); *E21B 7/025* (2013.01); *E21B 19/087* (2013.01); *E21B 19/14* (2013.01); *E21B 19/16* (2013.01); *E21B 19/20* (2013.01)

(58) Field of Classification Search

CPC ..... E21B 19/146; E21B 19/20; E21B 19/14; E21B 19/16; E21B 19/087; E21B 7/025

See application file for complete search history.

(56) References Cited

FOREIGN PATENT DOCUMENTS

| | | | |
|---|---|---|---|
| DE | 19926055 | A1 | 12/2000 |
| DE | 19957903 | A1 | 6/2001 |
| EP | 2765272 | A1 | 8/2014 |
| WO | 2010092236 | A1 | 8/2010 |

*Primary Examiner* — D. Andrews

(74) *Attorney, Agent, or Firm* — Corinne R. Gorski

(57) ABSTRACT

The disclosure relates to a changing device, rock drilling unit and a method of changing drill rods in rock drilling. The changing device includes a first drill rod station for receiving a second drill rod and a second drill rod station for receiving a third drill rod. The second drill rod station may be moved to the first drill rod station and the first drill rod station may be moved to drilling axis by moving the whole changing device in a transverse direction relative to a feed beam.

13 Claims, 6 Drawing Sheets

DRILL ROD CHANGER, ROCK DRILLING UNIT AND METHOD OF CHANGING DRILL RODS

RELATED APPLICATION DATA

This application claims priority under 35 U.S.C. § 119 to EP Patent Application No. 15201043.5, filed on Dec. 18, 2015, which the entirety thereof is incorporated herein by reference.

TECHNICAL FIELD

The present disclosure relates to a changing device for handling drill rods in connection with rock drilling and further to a rock drilling unit provided with a drill rod changing device and a method of changing drill rods in the rock drilling unit.

BACKGROUND

In mines and other work sites rock drilling rigs are used for drilling bore holes on rock surfaces. Typically the rock drilling rig includes one or more drilling booms which are provided with drilling units. Document EP-2765272-A1 discloses means for gripping one drill rod. In many cases a drill hole having a greater length than one drill rod needs to be drilled so two or more drill rods need to be connected to each other in order to form an extension rod. This is called extension rod drilling.

Typically several drill rods are stored in a rod magazine, which is located at the drilling unit. Document WO-2010/092236-A1 discloses an example of a rod magazine. However, such a rod magazine is large and heavy, whereby it may hamper the drilling. Thus, the existing solutions have shown to contain some disadvantages.

SUMMARY

To overcome the above disadvantages, the present disclosure is directed to a changing device, rock drilling unit provided with change means and a method of changing drill rods.

According to a first aspect, the changing device includes a body, which is connected movably to a drilling unit. The changing device further includes a first drill rod station for receiving one single changeable drill rod and gripping means at the first drill rod station so that the drill rod, which is located at the first drill hole station may be gripped and released when handling the drilling rods. In connection with the changing device there are also one or more transfer devices for moving the changing device in the transverse direction relative to longitudinal axis of the drilling unit. In addition to the first drill rod station, the changing device also includes one or more second drill rod stations each of them being capable to receive one single additional drill rod. The one or more second drill rod stations are selectively movable to the first drill rod station and away to a side position.

Two or more drill rods may be stored and handled by the changing device without a need to furnish a drilling unit with a complicated, large-sized and heavy rod magazine. The changing device with the first and second drill rod stations may have a slim and light weight structure, which does not obstruct visibility and does not add unnecessary weight to the drilling unit. Due to the simple structure and operation, the present changing device may be reliable and inexpensive.

According to an embodiment, the changing device is provided with only one single first drill rod station and one single second drill rod station. Thus, the device has two drill rod stations. One drill rod may be located on the drilling axis and two drill rods at the two drill rod stations. The three drill rods may then be handled by the rock drilling unit.

According to an embodiment, the second drill rod station is only movable stepwise between two extreme positions. The second drill rod station can be moved without stoppage to intermediate positions between the first drill station and the side position, which are located at extreme positions of a movement range of the second station. Due to the movements only to the extreme positions, controlling of the movement, as well as the movement means may be simple but still the positioning to the extreme positions may be accurate.

According to an embodiment, the changing device is provided with two second drill rod stations which are both moved simultaneously. The two second drill rod stations may be moved by means of a fluid operated cylinder provided with three end positions. This type of actuator is known as a double-piston-rod cylinder. Alternatively, the two second drill rod stations may be moved simultaneously along suitable guide surfaces by means of a motor, for example.

According to an embodiment, the second drill rod station is supported on the changing device and is thereby always moved together with the changing device.

According to an embodiment, the second drill rod station is located at a distal end portion of the changing device.

According to an embodiment, the second drill rod station is located at a distal end portion of the changing device and at a greater distance from a pivot point of the changing device. Thereby, the second drill rod station moves along a greater circular arch compared to movement path of the first drill rod station. When the changing device is in its basic position at a side of the drilling axis, the second drill rod station is located above the first drill rod station. In other words, the second drill rod station is never located between the first drill rod station and the pivot point.

According to an embodiment, the second drill rod station is supported by means of pivot means which allow pivoting the second drill rod station along arc shaped movement path relative to the body of the changing device. Thus, the second drill rod station is movable between the first drill rod station and the side position by means of a turning actuator. The turning actuator may be a linear actuator or a turning motor, for example.

According to an embodiment, the second drill rod station is movable relative to the pivot means by means of a fluid operated cylinder. Hydraulically or pneumatically operated cylinders are simple and reliable actuators which suit well for the purpose.

According to an embodiment, the second drill rod station is movable relative to the pivot means by means of an electrically operated actuator, such as a motor or linear motor.

According to an embodiment, the second drill rod station is supported by a linear support means and is thereby movable linearly between the first drill rod station and the side position. The second drill rod station may be moved by means of a linear moving actuator, which may be a pressure medium operated cylinder, for example.

According to an embodiment, the second drill rod station includes at least one clamp element, which is operable without external driving power and is configured to hold the drill rod at the second station. The clamp element may have contact surfaces, which are pressed against an outer surface of a retained drill rod when the rod is placed between the contact surfaces. Due to the continuous pressing force, the retained drill rod holds its position firmly and does not vibrate and cause noise.

Further, outer dimensions of the drill rod may vary but the clamp will still hold the drill rods properly. The clamp may be spring-actuated, having one or more spring elements for producing the needed press force. Alternatively, the clamp may be made of resilient material or it may include support surfaces made of resilient material for producing the needed press force. The resilient material may be polyurethane (PUR) or other plastic material, for example. Alternatively, the resilient material may be rubber or polymeric material.

The clamp element may be a resilient element supported between two plate-like pieces made of metal material. The rigid support pieces may be provided with hinge and connecting means and the resilient clamping piece may serve only for clamping purpose.

According to an embodiment, the second drill rod station includes at least one clamp element for holding the drill rod at the second station. The clamp element may be supported by means of a pivot pin of a separate frame or frame piece, which is fastened to a side surface of the body of the changing device. Thus, the clamp element may be moved between the extreme positions relative to the pivot pin by means of a turning actuator. The turning actuator may be a hydraulic cylinder arranged between the clamp element and the frame.

According to an embodiment, the separate frame for supporting the clamp element is a plate-like piece. Thus, the frame structure is simple and easy to manufacture, and further, it may only take very little space.

According to an embodiment, the clamp element, the pivot pin, the separate frame and the hydraulic cylinder constitute an auxiliary module, which is easily mountable and dismountable to the changing device. This embodiment allows retrofitting of an additional drill rod station to the changing device.

According to an embodiment, the changing device includes an upper support surface for providing overhead support for a drill rod, which is hold at the second drill rod station. The support surface may be formed as an integral part of a plate-like frame of the changing device and may include a protruding part at an outermost end of the frame. The overhead support may secure retain of the drill rod and may thereby increase reliability of operation.

According to an embodiment, the clamp element includes an opening through which the drill rod may be inserted inside the clamp utilizing side ward movement of the changing device relative to the drilling axis.

According to an embodiment, the rock drilling unit is without any drill rod magazine or storage device for storing more than one single drill rod. Thanks to the disclosed solution, more than one drill rods can be drilled successively, and still, there is no need to provide the rock drilling unit with any conventional rod magazine. Thus, the rock drilling unit may be lightweight. The reach of a drilling boom may be dimensioned extensive when a lightweight rock drilling unit does not limit the range of the boom.

According to an embodiment, the rock drilling unit is provided with at least one additional support element in order to provide for the drill rod, which is located at the second drill rod station, additional support when the changing device is moved between the drilling axis and the side position. The additional support element may be immovable relative to the feed beam and the changing device.

According to an embodiment, the changing device is connected by pivot means to the feed beam and is configured to be pivoted relative to the pivot means when being moved between the drilling axis and the side position. The rock drilling unit is also provided with at least one additional support element having an arc shaped support surface for providing support for the drill rod located at the second drill rod station when the changing device is turned. The additional support surface is absent at the side position of the changing device and thereby allows the drill rod located at the second drill rod station to be moved to the first drill rod station. The additional support element may be a plate-like piece fastened transversely to the feed beam.

According to an embodiment, the changing device includes at the first drill rod station gripping jaws for supporting the drill rod therein and at the second drill rod station there is a clamp element for retaining the drill rod. The gripping jaws serve as gripping means so that rotation of gripped drill rods can be prevented when opening and closing connecting threads, for example. The clamp element is independently operable relative to the gripping jaws. Further, when the second drill rod station is moved to the first drill rod station, then the drill rod of the second drill rod station may be additionally supported by means of the griping jaws of the first drill rod station. At the drilling axis the gripping jaws are released and the changing device is moved backwards whereby the drill rod moved to the drilling axis is released also from the clamping element of the second drill rod station.

According to an embodiment, at least two changing devices provided with the above disclosed features are arranged at a distance from each other as seen in the longitudinal direction of the feed beam. Due to this embodiment, secure and stabile support is achieved for the retained drill rod. A first changing device and a second changing device may be located at distances from the distal ends of a feed beam.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
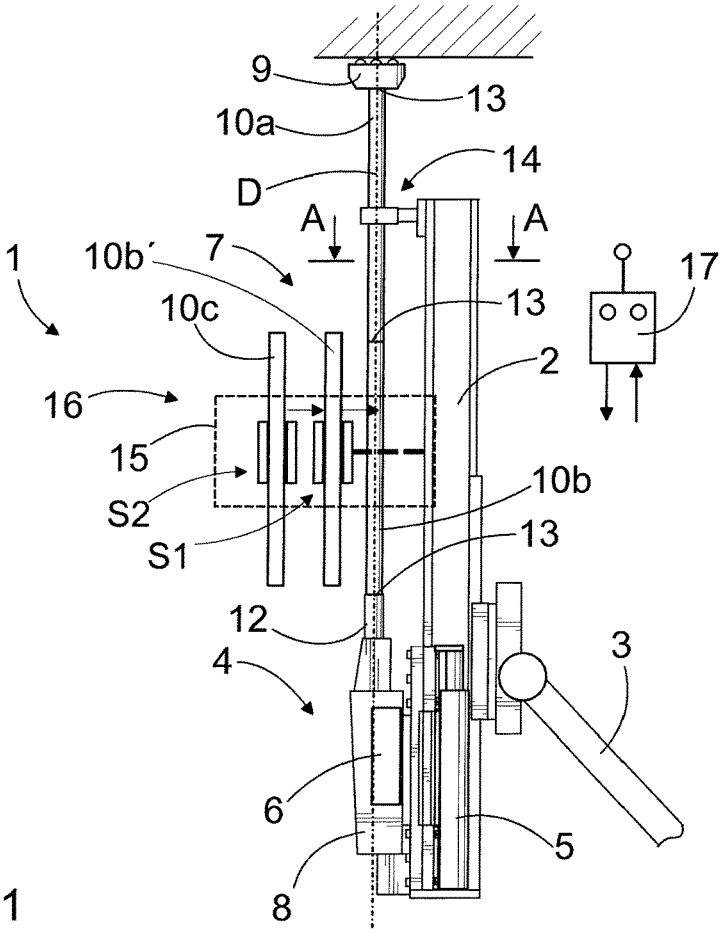
FIG. 1 is a schematic side view showing a rock drilling unit.

FIG. 1 shows a rock drilling unit 1, which may be connected by means of a boom 3 to a movable carrier, which is not shown. The drilling unit 1 may have a feed beam 2 provided with a rock drilling machine 4 that can be moved on the feed beam 2 by means of a feed device 5. The rock drilling machine 4 may have a percussion device 6 for generating impact pulses on a tool 7, and a rotating device 8 for rotating the tool 7. The tool 7 is located at drilling axis.

At a drilling site, one or more drill holes are drilled with the drilling unit 1. The drill holes may be drilled in the vertical direction, as shown in FIG. 1.

When a drill hole having a length longer than one single rod needs to be drilled, then an extension rod system is formed by connecting two or more drill rods successively. Typically, the extension system formed of three drill rods is sufficient. Then, the tool 7 includes a drill bit 9, a first drill rod 10*a*, a second drill rod 10*b* and a third drill rod 10*c*.

In FIG. 1, the third drill rod 10*c* is located at a side position relative to the drilling axis D. At the beginning of drilling the drill bit 9 is connected to the distal end of the first drill rod 10*a*, and the opposite end of the first drill rod 10*a* is connected to a shank 12 of the drilling machine 4. After the drilling of the first drill rod 10*a* is completed, the second drill rod 10*b* is connected to the shank 12 and the first drill rod 10*a*. Further, after the drilling of the second drill rod 10*b* is completed, then the third drill rod 10*c* is connected to the extension system and the drilling is continued to the final depth. Between the drill rods 10*a*-10*c*, between the first drill rod 10 and the drill bit 9, and between the third drill rod 10*c* and the shank 12, there are connecting means, such as connecting screws 13. The connecting screws 13 can be closed and opened by means of the rotating device 8. When connecting and disconnecting components of the tool 7, a retaining device 14 may be utilized for preventing rotation of tool components. The retaining device 14 is mounted on the feed beam 3 so that it is located on the drilling axis D. The retaining device 14 may include retaining jaws or corresponding means for gripping the tool component. The retaining device 14 further includes one or more actuators for generating the needed retaining force.

The rock drilling unit 1 may be provided with one or more changing devices 15, which are located at a proximity to the drilling axis D and can be moved in transverse direction relative to the drilling axis D. In FIG. 1, one single changing device 15 is shown in a highly simplified manner. The changing device 15 is capable to hold two drill rods 10*b*, 10*c* at a side position 16 in a parallel direction relative to the drilling axis D. The second drill rod 1013' may be located initially at a first drill rod station S1 and can be moved by means of the changing device to the drilling axis D. The third drill rod 10*c* may be stored at a second drill rod station S2 of the changing device 15 and can be moved to the first drill rod station S1 and further to the drilling axis D. The movements between the drill rod stations S1 and S2 and the movements between the side position 16 and the drilling axis D may be linear movements or turning movements.

Figure 3:
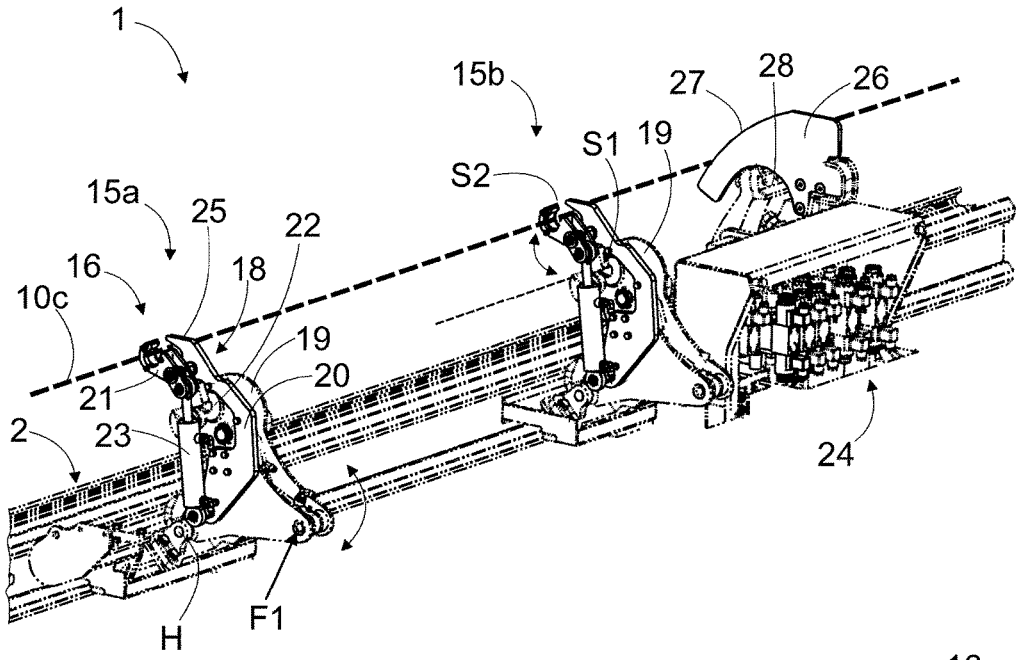
FIGS. 3 and 4 are schematic side views showing a drilling unit provided with two changing devices.
Figure 4:
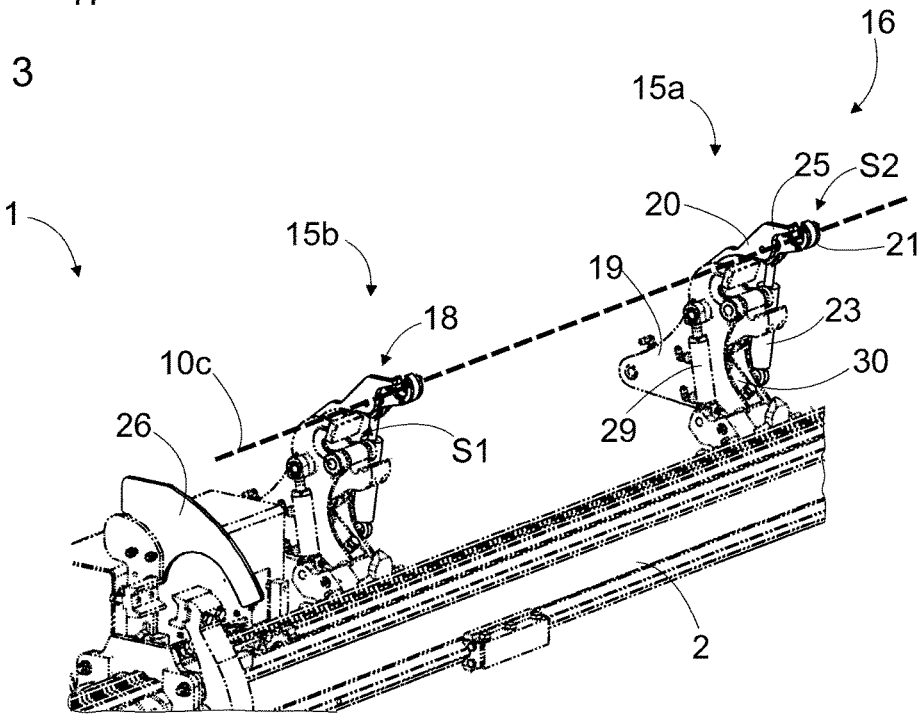

As it is shown in FIGS. 3 and 4, two changing devices 15*a*, 15*b* may be arranged at a selected distance from each other for retaining the drill rods 10*b* and 10*c* at the side position 16 and moving the rods between the side position 16 and the drilling axis D. The first drill rod 10*a* may be placed at the drilling axis D manually. During the manual operation, the rock drilling unit 1 may be shut down for safety reasons. An operator of the drilling unit 1 may control the drill rod change operations manually by means of a control unit 17, or alternatively the control unit 17 may have one or more automatic control programs for controlling the drill rod changing measures.

Figure 2:
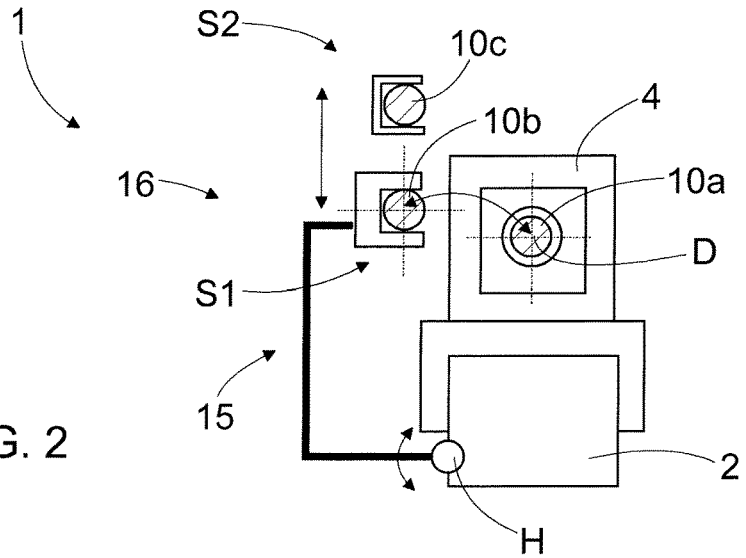
FIG. 2 is a schematic view showing the rock drilling unit at position A-A.

FIG. 2 illustrates the rock drilling 1 of FIG. 1 as seen from its front side and at position A-A. The changing device 15 may be supported on the feed beam 2 by means of a hinge H, whereby the first drill rod station S1 may be turned from the side position 16 to the drilling axis D, and vice versa. FIG. 2 further shows that the second drill rod station S2 may be moved to the first drill rod station S1.

FIGS. 3 and 4 disclose that the changing devices 15*a*, 15*b* may be provided with auxiliary devices 18 mounted to basic bodies or frames 19 of the changing devices. The auxiliary devices 18 or units may include frames 20.

Further, the auxiliary devices 18 may be provided with clamping elements 21 for receiving the third drill rod 10*c* and serving as the second drill rod station S2. The basic structure of the changing device 15 may include gripping jaws 22 or corresponding means for holding the drill rods at the first drill rod station S1. The changing device 15 may be turned from the side position 16 towards the drilling axis D by directing a force F1 to it. The force F1 may be formed by means of a hydraulic cylinder, for example. The second drill rod station S2 may be turned to the first drill rod station S1 by turning actuator 23, which may be a pressure medium cylinder, for example. The feed beam 2 may be provided with a control box 24 wherein the needed control valves and other control means for controlling the operation of the changing devices 15*a*, 15*b* may be arranged.

The changing device 15 may also have an overhead support 25 for supporting the third drill rod 10*c* at the second drill rod station S2. The support 25 may be a protruding section formed at an outermost end of the frame 20 of the auxiliary device 18. Furthermore, the feed beam may be provided with an additional support element 26 including a curved support surface 27, which may offer support for the third drill rod 10*c* when the changing device 15 is moved between the side position 16 and the drilling axis D. The additional support element 26 may be a relatively simple plate-like piece, which is arranged in transverse direction relative to the longitudinal axis of the feed beam 2. Shape and dimensions of the additional support element 26 are designed to not hamper indexing of the second drill rod station S2 to the first drill rod station S1 when the changing devices 15*a*, 15*b* are moved at their extreme side positions. Further, the additional support element 26 may have an inner space 28 providing space for moving the drill rod being gripped by the first drill rod station S1.

It should be noted that the second drill rod station S2, the clamping element 21, and the turning actuator 23 may alternatively be arranged directly to the basic structure of the changing device 15, whereby no separate frame 19 is needed.

In FIG. 4 the actuators of the changing devices 15*a*, 15*b* are shown. The changing devices 15*a*, 15*b* may be turned in transverse direction relative to the feed beam 2 by means of cylinders 29 and gripping jaws 22 of the first drill rod station S1 may be actuated by means of a cylinder 30.

Figure 5A:
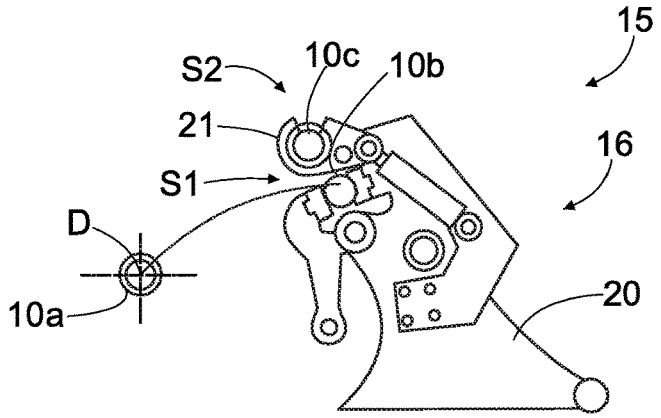
FIGS. 5*a*-5*h* are schematic views showing operation of a changing device and utilization of an additional second drill rod station.
Figure 5B:
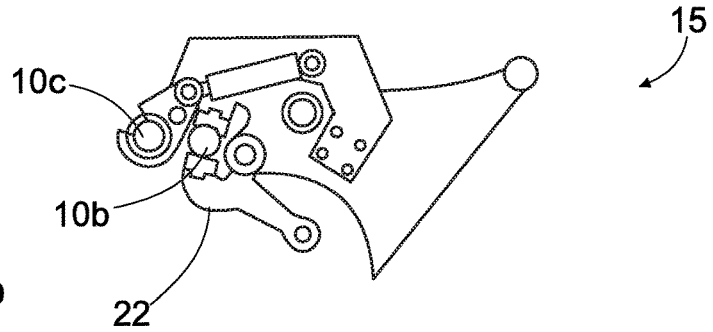
Figure 5C:
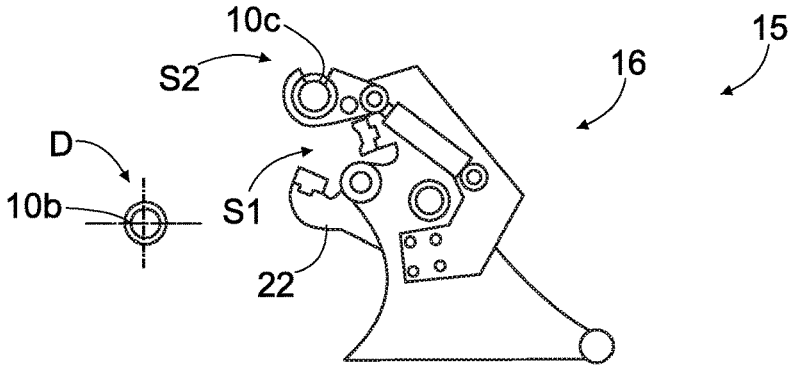
Figure 5D:
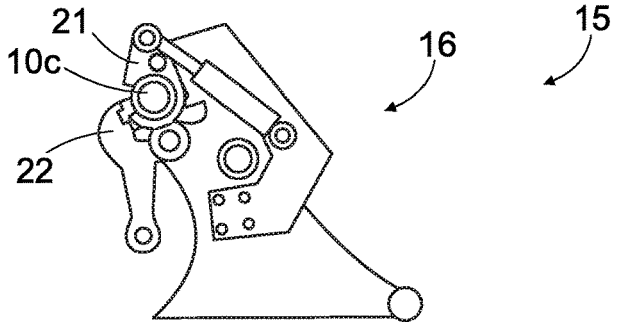
Figure 5E:
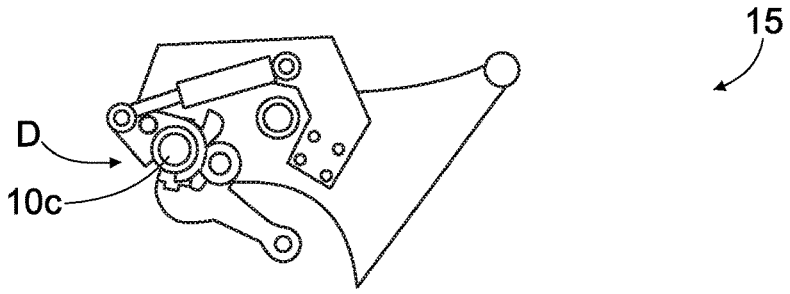
Figure 5F:
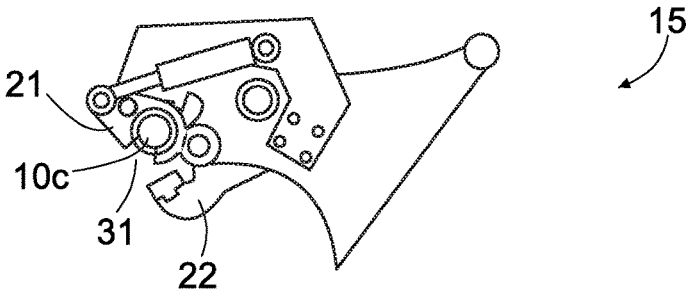
Figure 5G:
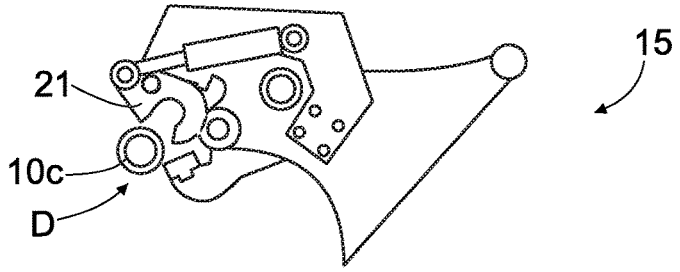
Figure 5H:
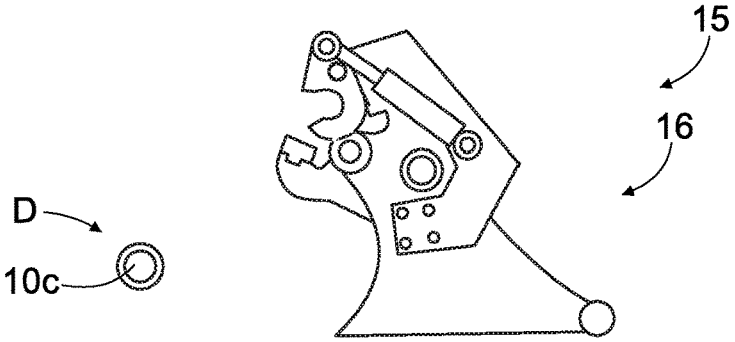

FIGS. 5*a* 5*h* demonstrate the operation of the changing device in a simplified manner. In FIG. 5*a* the changing device 15 is at the side position 16. The first drill rod 10*a* is at the drilling axis D, the second drill rod 10*b* is at the first drill rod space S1 and the third drill rod 10*c* is at the second drill rod space S2.

In FIG. 5*b* the changing device 15 is turned towards the drilling axis D in order to bring the second drill rod 10*b* to the drilling axis D. Then, the second drill rod 10*b* may be connected to the first drill rod 10*a*. The third drill rod 10*c* is at the second drill rod station S2 and moves simultaneously above at a distal part of the changing device 15.

In FIG. 5*c* the gripping jaws 22 of the changing device 15 are opened and the changing device 15 is reversed back to the initial side position 16.

In FIG. 5*d* the turning actuator 23 is actuated and the second drill rod station S2 together with the third drill rod 10*c* is moved to the first drill rod station S1. Then, the third drill rod 10*c* may be gripped by means of the gripping jaws 22.

In FIG. 5*e* the changing device is again turned towards the drilling axis D for feeding the third drill rod 10*c*, which is at the first drill rod station S1, to the drilling axis D. Thereafter the third drill rod 10*c* is coupled to the second drill rod 10*b*.

In FIG. 5*f* the gripping jaws 22 are opened and in FIG. 5*g* the changing device 15 has already started reversing movement towards the side position 16. Since the clamp element 21 of the second drill rod station S2 includes an opening 31, which is facing towards the drilling axis D, the changing device 15 may be turned back to the side position shown in FIG. 5*h*. When the extension drill rod system is dismantled, the changing device 15 may be operated in an opposite working order.

Figure 6A:
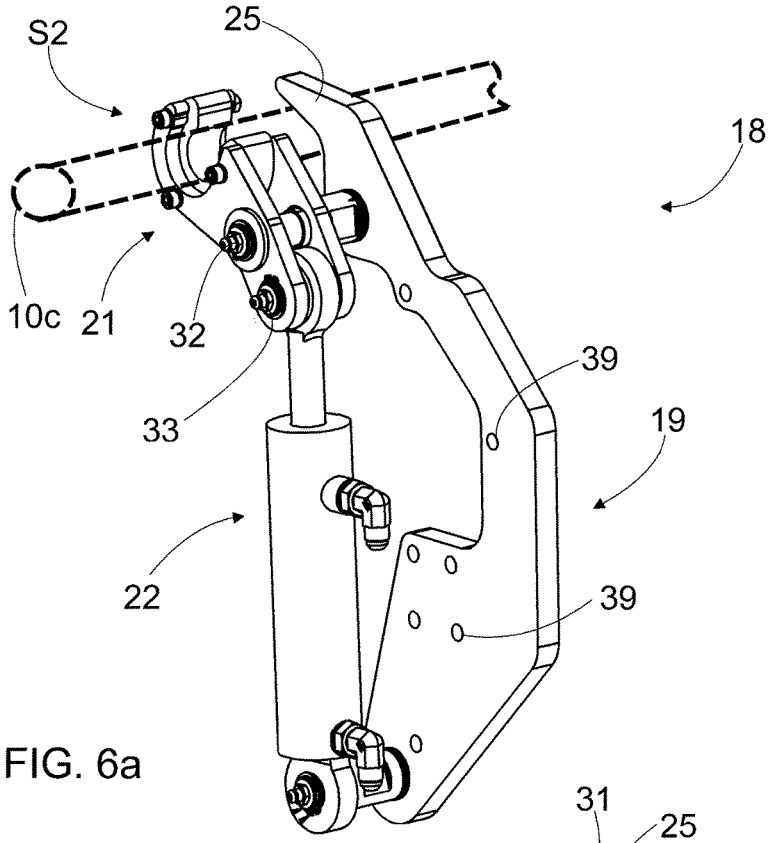
FIGS. 6*a* and 6*b* are schematic views showing an auxiliary module, which is provided with a second drill rod station and is mountable to a changing device.
Figure 6B:
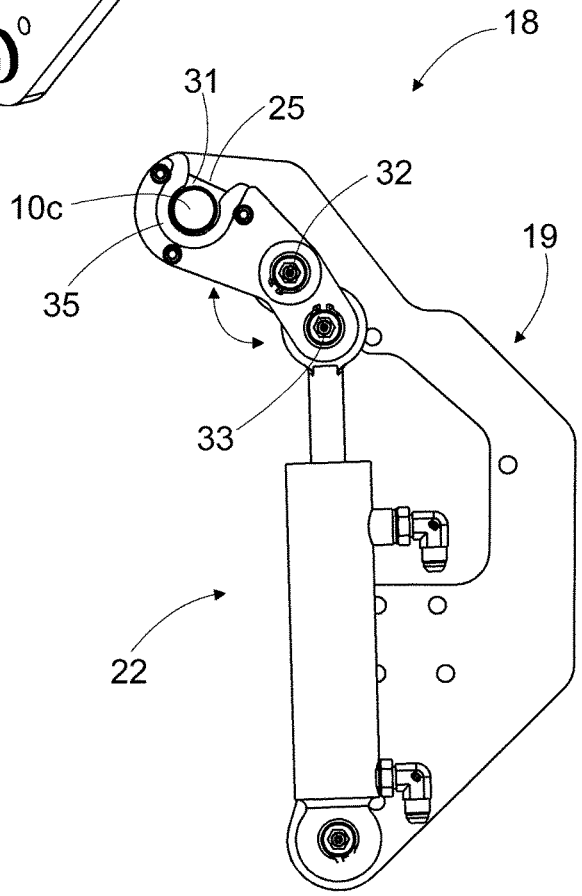

FIGS. 6*a* and 6*b* show the auxiliary device 18 in a more detailed manner. The auxiliary device 18 may include a frame 19, and the frame 19 may be a plate-like piece provided with fastening means so that it may be coupled to the changing device. The fastening means may allow fast-coupling of the auxiliary device. The frame 19 may be provided with fastening holes 39 for fastening screws. The frame 19 may also be provided with bearing points 32, 33 for connecting the turning actuator 22 and the clamp element 21 to the frame 19. Further, the frame 19 may include a support 25, which may serve as an overhead support at the second drill rod station S2 and may prevent release of the third drill rod 10*c* from the clam element 21 through the opening 31

Figure 7A:
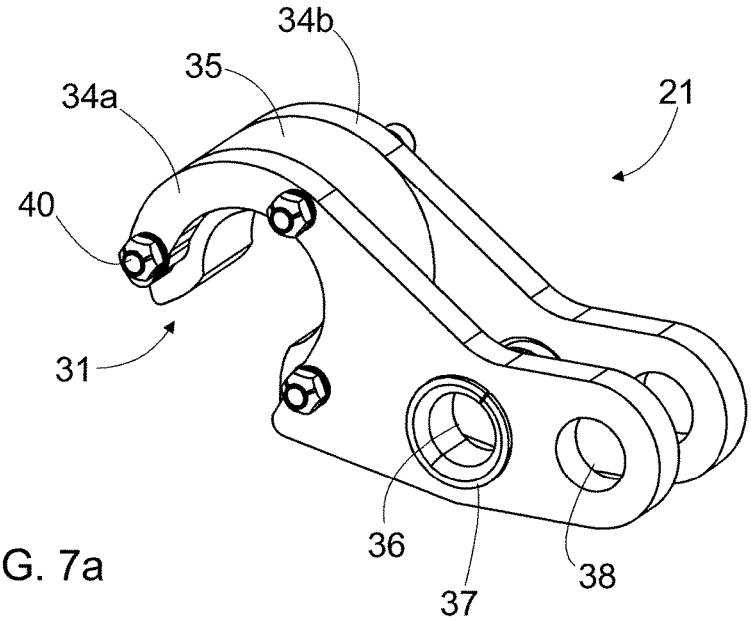
FIGS. 7*a* and 7*b* are schematic views showing a clamp element of a second drill rod station.
Figure 7B:
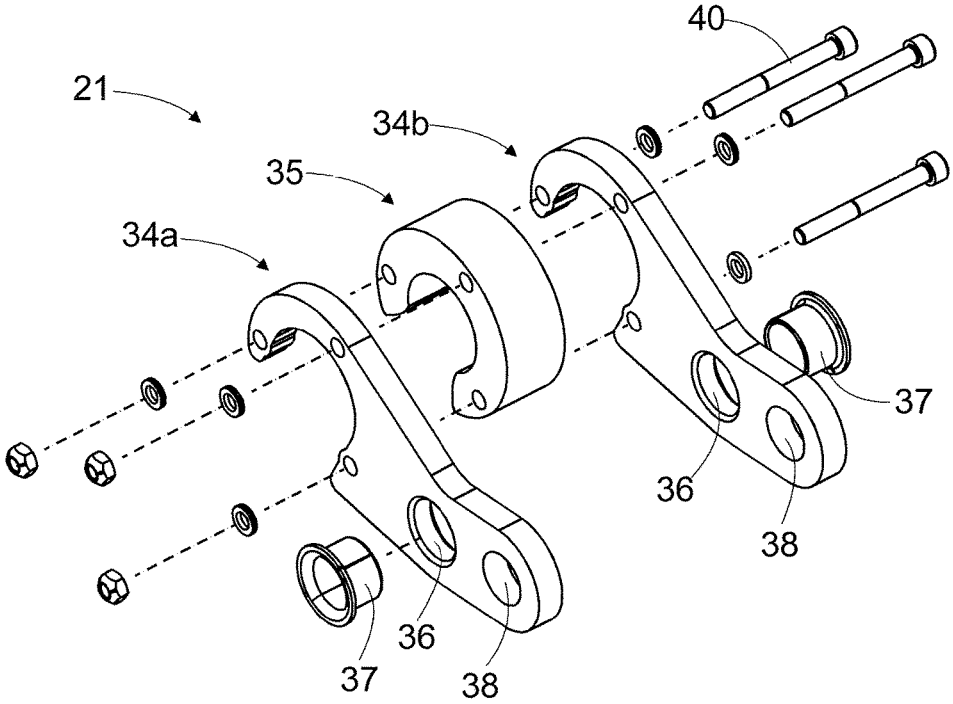

FIGS. 7*a* and 7*b* show in more detailed the structure of the clamp element 21. The clamp element 21 may have two side-plates 34*a*, 34*b* between which may be an intermediate element 35. The side-plates 34*a*, 34*b* may serve as a frame structure for the clamp element 21 and may transmit support and movement forces to the intermediate element 35. The intermediate element 35 may be made of resilient material and an inner shape of the intermediate element 35 may be designed in accordance with outer profiles of the used drill rods. The intermediate element 35 may be changed in case the shape or dimensions of the drill rods change or if the intermediate element 35 becomes worn. The side-plates 34*a*, 34*b* are provided with openings 36 for pivoting means and the openings may be furnished with bearings 37, which may be changeable slide bearings. The side-plates 34*a*, 34*b* also have openings 38 allowing the turning actuator to be coupled the claim element 21 by a suitable connecting pin or bolt, for example. The structure of the clamp element 21 may be assembled by means of fastening screws 40.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A changing device for handling drill rods in connection with a rock drilling unit having a longitudinal drilling axis and a first drill rod located on the longitudinal drilling axis, the changing device comprising:

a body movably connected to the drilling unit;

a first drill rod station for receiving one single changeable drill rod;

a gripping device at the first drill rod station arranged for gripping and releasing the one single changeable drill rod located at the first drill rod station;

at least one transfer device arranged to move the changing device in a transverse direction relative to a longitudinal axis of the drilling unit, the changeable drill rod being located initially at the first drill rod station and then moved by the changing device to the first drill rod at the drilling axis; and at least one second drill rod station configured to receive one single additional drill rod, the second drill rod station being selectively movable to the first drill rod station and away to a side position relative to the longitudinal drilling axis.

2. The changing device as claimed in claim 1, wherein the second drill rod station is only movable stepwise between two extreme positions without stoppage to intermediate positions between the first drill rod station, the side position being located at extreme positions of a movement range of the second station.

3. The changing device as claimed in claim 1, wherein the second drill rod station is located at a distal end portion of the changing device.

4. The changing device as claimed in claim 1, wherein the second drill rod station is supported by pivot means which arranged to pivot the second drill rod station along an arc shaped movement path relative to the body of the changing device, the second drill rod station being movable between the first drill rod station and the side position by a turning actuator.

5. The changing device as claimed in claim 4, wherein the second drill rod station is movable relative to the pivot means by a fluid operated cylinder.

6. The changing device as claimed in claim 1, wherein the second drill rod station includes at least one clamp element, which is operable without external driving power and is configured to hold the additional drill rod at the second station.

7. The changing device as claimed in claim 1, wherein the second drill rod station includes at least one clamp element, the clamp element being supported by a pivot pin to a separate frame fastened to a side surface of the body of the changing device, the clamp element being movable between the extreme positions relative to the pivot pin by a hydraulic cylinder arranged between the clamp element and the frame.

8. A rock drilling unit comprising:

an elongate feed beam;

a rock drilling machine arranged movably on the feed beam and defining a drilling axis, whereby the rock drilling machine includes a shank for connecting a first drill rod to the drilling axis; and at least one changing device including a body connected movably to the feed beam, a first drill rod station for receiving one single changeable drill rod, a gripping device at the first drill rod station and arranged to grip and release the changeable drill rod located at the first drill rod station, and at least one transfer device arranged to move the changing device in a transverse direction relative to the feed beam and for positioning the gripping device at a side position relative to the drilling axis, the changeable drill rod being located initially at the first drill rod station and then moved by the changing device to the first drill rod at the drilling axis, and at least one second drill rod station configured to receive one single additional drill rod, the second drill rod station being selectively movable to the first drill rod station and away to the side position relative to the longitudinal drilling axis, and wherein the changing device allows one single drill rod at a time to be stored at the second drill rod station.

9. The rock drilling unit as claimed in claim 8, further comprising at least one additional support element arranged to provide for the drill rod, which is located at the second drill rod station, additional support when the changing device is moved between the drilling axis and the side position.

10. The rock drilling unit as claimed in claim 9, wherein the changing device is connected by a pivot means to the feed beam and is configured to be pivoted relative to the pivot means when being moved between the drilling axis and the side position, the additional support element having an arc shaped support surface for providing support for the drill rod located at the second drill rod station when the changing device is turned, and the additional support surface being absent at the side position of the changing device to allow the drill rod located at the second drill rod station to be moved to the first drill rod station.

11. A method of changing drill rods in a rock drilling unit, the rock drilling unit including a feed beam, a rock drilling machine and at least one retainer device, the method comprising:

connecting at least two drill rods together at a drilling axis of the drilling machine for forming an extension rod assembly;

dismantling the extension rod assembly after drilling;

holding the extension rod assembly by the retainer device, wherein the connecting and dismantling includes moving the drill rods in a transverse direction relative to the feed beam between the drilling axis and at least one side position, the side position being parallel to the drilling axis and located at a distance from the drilling axis;

moving the drill rods between the drilling axis and the side position by at least one changing device arranged to be transversally movable relative to the feed beam;

providing the changing device with a first drill rod station and a second drill rod station, which are both capable of supporting one single drill rod at a time;

moving the first drill rod station between a first storage position and the drilling axis by moving the changing device relative to the feed beam;

moving the second drill rod station between a second storage position and the first storage position by moving the second drill rod station relative to the changing device; and moving the second drill rod station from the first storage position to the drilling axis by moving the changing device relative to the feed beam.

12. The method as claimed in claim 11, further comprising supporting the drill rod at the first drill rod station by gripping jaws and supporting the drill rod at the second storage position by a clamp element being independently operable relative to the gripping jaws.

13. The method as claimed in claim 11, further comprising providing additional support for the drill rod being stored at the second drill rod station when the changing device is moved between the drilling axis and the side position.

* * * * *